US005837418A

United States Patent [19]

Arai et al.

[11] Patent Number: 5,837,418

[45] **Date of Patent: *Nov. 17, 1998**

[54] SILVER HALIDE BLACK AND WHITE PHOTOGRAPHIC LIGHT SENSITIVE MATERIAL

[75] Inventors: Takeo Arai; Junichi Fukawa, both of Tokyo, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 636,339

[22] Filed: Apr. 23, 1996

[30] Foreign Application Priority Data

Apr. 26, 1995 [JP] Japan ..... 7-125866

[51] Int. Cl.[6] ..... G03C 1/06

[52] U.S. Cl. ..... 430/264; 430/503; 430/546

[58] Field of Search ..... 430/264, 506, 430/546, 503

[56] References Cited

U.S. PATENT DOCUMENTS 4,920,034 4/1990 Sasaoka et al. ..... 430/264
5,478,696 12/1995 Arai ..... 430/264

FOREIGN PATENT DOCUMENTS 0591833 4/1994 European Pat. Off. .

*Primary Examiner*—Thorl Chea
*Attorney, Agent, or Firm*—John B. Bierman; Bierman, Muserlian and Lucas

[57] ABSTRACT

A silver halide black-and-white photographic light sensitive material is disclosed, comprising a support provided thereon a silver halide emulsion layer and provided farther from the support another higher-sensitive silver halide emulsion layer, wherein both silver halide emulsion layers each have a coating weight of silver of not less than 0.5 g/m$^2$ and are sensitized substantially to the same spectral region; at least two, different hydrazine compounds being contained in the silver halide emulsion layers or another photographic component layer.

3 Claims, No Drawings

SILVER HALIDE BLACK AND WHITE PHOTOGRAPHIC LIGHT SENSITIVE MATERIAL

FIELD OF THE INVENTION

The present invention related to a silver halide black and white photographic light sensitive material and in particular to a silver halide black and white photographic light sensitive material suitable for use in lithographic printing plate-making.

BACKGROUND OF THE INVENTION

A photographic technique, capable of reproducing an image with ultra-high contrast, as applied to a light sensitive material suitable for use in lithographic plate-making and various techniques is known. Among these known techniques are known a silver halide photographic light sensitive material containing a hydrazine compound described in U.S. Pat. No. 4,269,929 and a silver halide photographic light sensitive material containing a nucleation-accelerating compound, as described in JP-A 4-98239 (the term, "JP-A" means an "unexamined, published Japanese Patent Application"). Further, a technique in which a photographic material contains a hydrazine compound capable of releasing a photographic useful group upon redox reaction to thereby improve photographic performance is described in JP-A4-439. Furthermore, a roomlight-handling photographic material which contains two kinds of hydrazine compounds having nucleation activity is described in JP-A 5-165149. In these materials, however, the sensitivity is largely dependent on the level of the developer, so that it. is a barrier to lower the replenishing rate.

With the recent spread of screening systems, such as FM screening and high definition output, which are susceptible to influence of the sensitivity level, a photographic material with little dependence on developer activity and high contrast has been diligently sought.

SUMMARY OF THE INVENTION

In response to the above problems, an object of the present invention is to provide a silver halide black-and-white photographic material having excellent photographic performance in high definition output and little dependence on variation of developer level, and a preparation method thereof. Another object of the invention is to provide a silver halide black-and-white photographic light sensitive material which barely deteriorates in photographic performance even when processed at a low replenishing rate.

The above objects of the present invention is accomplished by a silver halide black-and-white photographic light sensitive material comprising a support having thereon photographic component layers including a first silver halide emulsion layer and a second silver halide emulsion layer, the second silver halide emulsion layer being provided on the first silver halide emulsion layer and having a sensitivity higher than that of the first silver halide emulsion layer, wherein said first and second silver halide emulsion Layers each have a coating weight of silver of not less than 0.5 $g/m^2$and are sensitized substantially to the same spectral region; at least two kinds of hydrazine compounds being contained in said photographic component layers.

A preparation method of a silver halide black-and-white photographic light sensitive material relating to the present invention is characterized in that at least two kinds of the hydrazine compounds are added into component layers in the form of a solid particle dispersion.

DETAILED DESCRIPTION OF THE INVENTION

In the present invention, a silver halide photographic light sensitive material comprises a support provided thereon a first silver halide emulsion layer, and provided farther from the support a second silver halide emulsion having a sensitivity higher than that of the first silver halide emulsion layer. The first and second silver halide emulsion layers have a spectral sensitivity substantially in the same wavelength region. These silver halide emulsion layers may be provided in contact with each other. An interlayer may be provided between them.

In the present invention, said two kinds of hydrazine compounds are preferably those having different activity in development nucleation. The expression, "having different activity in development nucleation" means that the sensitivity of a photographic light sensitive material prepared by adding each of the two hydrazine compounds to a silver halide emulsion in a given amount is different each from the other. The difference of the sensitivity is preferably from 20 to 200%, more preferably 50% to 150%. (Alternatively, the ratio in percentage of the sensitivity of one of photographic materials to that of the other photographic material is preferably from 120 to 300%, more preferably 150 to 250%.) In the invention, the sensitivity is defined as a reciprocal of exposure that gives a density of 3.0.

In one preferred embodiment of the invention, as described above, at least two hydrazine compounds which are different each from the other in activity of development nucleation is contained. These compounds are desirable to contribute to contrast increase. The layer containing the hydrazine compound or an adjacent layer thereto is a silver halide emulsion layer, which preferably has a silver coverage of 0.5 $g/m^2$ or more. These hydrazine compounds are preferably added to different layers.

When the layers are simultaneously coated, hydrazine compounds contained each layers may mixed with each other. When the hydrazine compounds are separately added to different layers, it is inhomogeneous and the inventive effect is displayed, as compared to case when added uniformly to each layers.

In a preferred embodiment of the invention, at least one of the two hydrazine compounds, preferably both of them are added in the form of a solid particle dispersion, whereby each of the hydrazine compounds are fixed to a specific layer and acts on silver halide contained in the layer or an adjacent layer. More preferably, hydrazine compounds each are added to an upper-side silver halide emulsion layer and a lower-side silver halide emulsion layer with a lower sensitivity, each in the form of a solid particle dispersion. In this case, the hydrazine compound contained in the lower layer has an activity higher than that of the hydrazine compound contained in the upper layer. Advantages due to that a hydrazine compound with higher activity is added to the lower layer with a lower sensitivity is to be superior in dot quality as well as development stability.

A hydrazine compound usable in the invention is a compound represented by the following formula (H).

Formula (H)

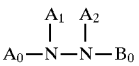

In the formula, $A_0$ is an aliphatic group, aromatic group or heterocyclic group. The aliphatic group represented by $A_0$ is an alkyl group having 1 to 30 carbon atoms, preferably 1 to 20 carbon atoms, which may be straight-chained, branched or cyclic. Examples thereof include methyl, ethyl, t-butyl, octyl, cyclohexyl and benzyl groups, which may be substituted by a substituent such as an aryl group, alkoxy group, aryloxy group, alkylthio group, arylthio group, soulfully group, sulfonamido group, sulfamoyl group, acylamino group or ureido group.

In formula (H), as the aromatic group represented by $A_0$ is cited a monocyclic or condensed cyclic aryl group such as a benzene ring or naphthalene ring.

In formula (H), the heterocyclic group represented by $A_0$ is preferably a heterocyclic group containing a hetero-atom selected from nitrogen, sulfur and oxygen, including a pyrrolidine ring, imidazole ring, tetrahydrofuran ring, morpholine ring, pyridine ring, quinoline ring, thiazole ring, benzthiazole ring, thiophene ring and furan ring.

Among these, $A_0$ is preferably an aryl group or heterocyclic group. The aryl group or heterocyclic group is preferably substituted. As examples of preferable substituents are cited an alkyl group, alalkyl group, alkenyl group, alkynyl group, alkoxy group, substituted amino group, acylamino group, sulfonylamino group, ureido group, urethane group, aryloxy group, sulfamoyl group, carbamoyl group, alkylthio group, arylthio group, sulfothio group, sulfinyl group, hydroxy group, halogen atom, cyano group, sulfo group, alkyloxycarbonyl group, aryloxycarbonyl group, acyl group, alkoxycarbonyl group, acyloxy group, carbonamido group, sulfonamido group, carboxy group and phosphoric amido group. These substituents maybe further substituted. Among these substituents, in the case where a photographic material is processed with a developer having a pH of 10.5 or less within the total processing time (Dry to dry time) of 60 sec. or less, a substituent containing an acidic group with a pKa of 7 to 11 is preferable. As examples thereof are cited sulfonamido group, hydroxy group and mercapto group, more preferably, sulfonamido group.

$A_0$ contains preferably a diffusion-proof group or a group promoting adsorption to silver halide. The diffusion-proof group is preferably a ballast group, which is used in non-diffusible photographic additives such as a coupler. As the ballast group is cited a photographically inactive group having 8 or more carbon atoms such as an alkyl group, alkenyl group, alkynyl group, alkoxy group, phenyl group, pheoxy group and alkylpheoxy group.

As examples of the group promoting adsorption to silver halide are cited a thiourea group, thiourethane group, mercapto group, thioether group, thione group, heterocyclic group, thioamido heterocyclic group, mercapto group and an adsorbing group as described in JP-A 64-90439.

$B_0$ represents a blocking group, preferably, $$—G_0—D_0$$

wherein $G_0$ is —CO—, —COCO—, —CS—, —C(=$NG_1D_1$)—, —SO—, —$SO_2$—or —P(O)($G_1D_1$)—, in which $D_1$ is a hydrogen atom, an aliphatic hydrocarbon group, aromatic hydrocarbon group or heterocyclic group. In the case where plural $D_1$s are present in a molecule, they may be the same or different from each other.

$D_0$ is an aliphatic hydrocarbon group, aromatic hydrocarbon group, heterocyclic group, amino group, alkoxy group or mercapto group.

$G_0$ is preferably —CO— or —COCO—, more preferably, —COCO—.

$D_0$ is preferably a hydrogen atom, alkoxy group or amino group.

$A_1$ and $A_2$, both of them are hydrogen atoms, or one of them is a hydrogen atom and the other is an acyl group such as acetyl group, trifluoroacetyl or benzoyl, sulfonyl group such as methanesulfonyl or toluenesulfonyl or oxalyl group such as ethoxalyl.

Examples of the compound represented by formula (H) are shown as below, but the present invention is not limited thereto.

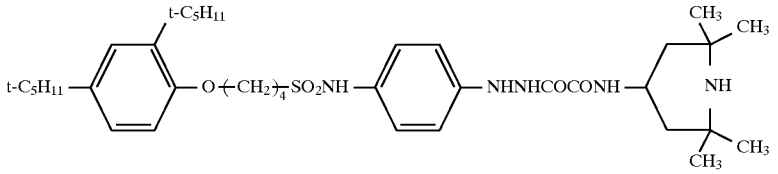

H-1

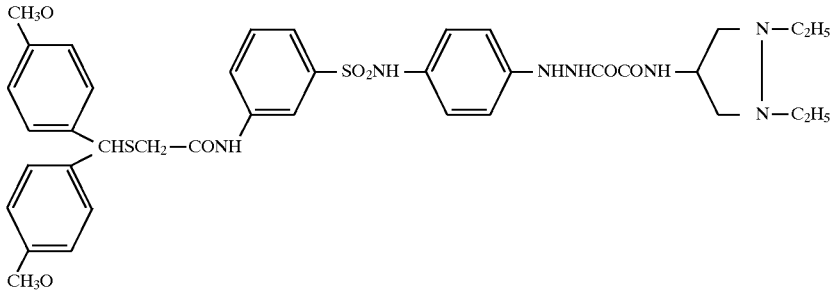

H-2

-continued
H-3
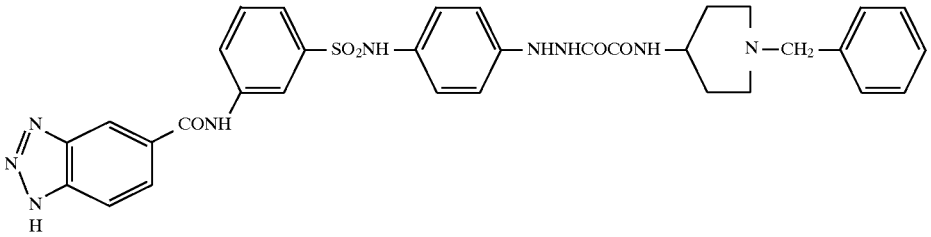
H-4
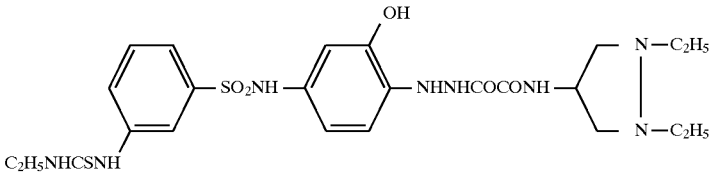
H-5
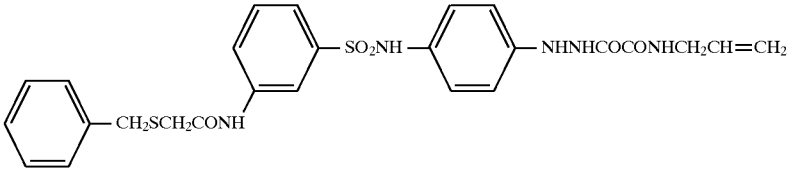
H-6
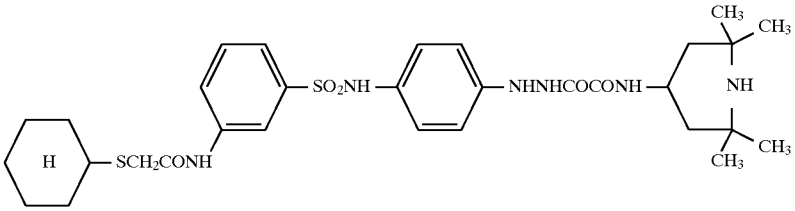
H-7
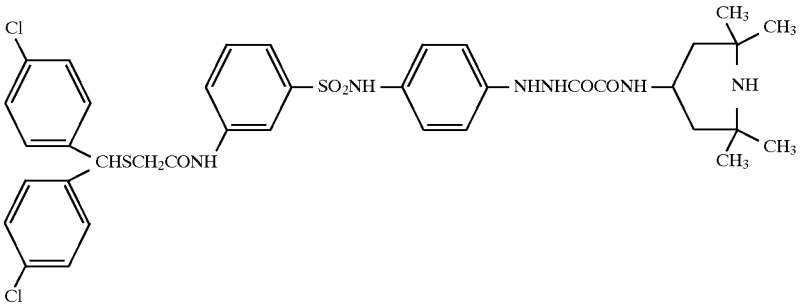
H-8
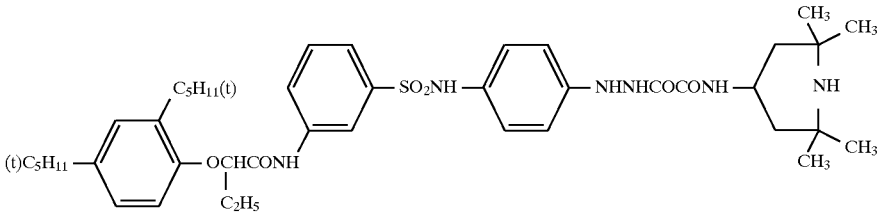
H-9
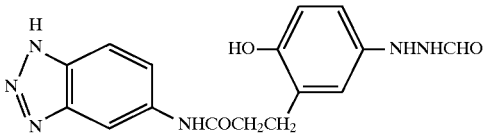
H-10
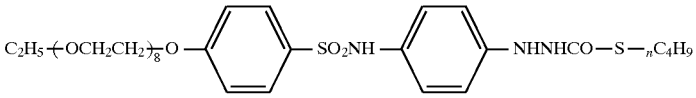

-continued
H-11
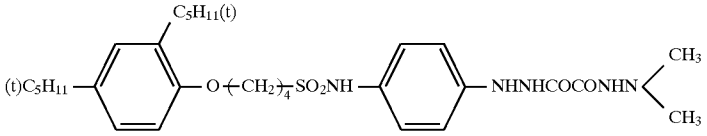
H-12
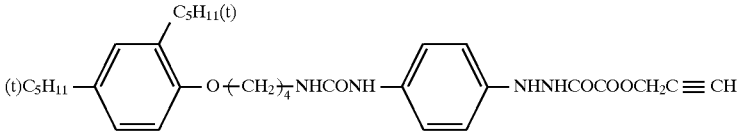
H-13
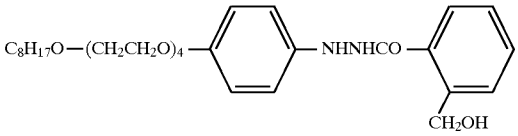
H-14
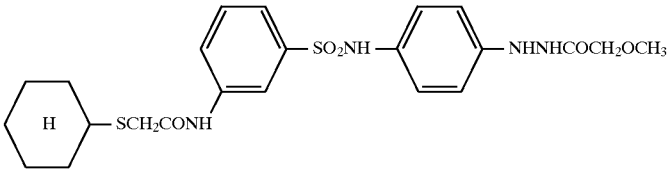
H-15
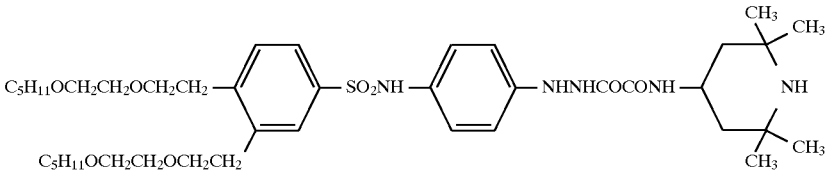
H-16
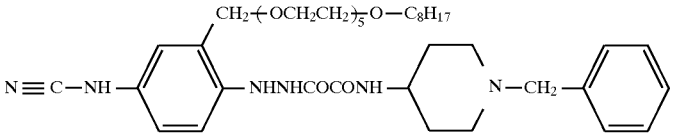
H-17
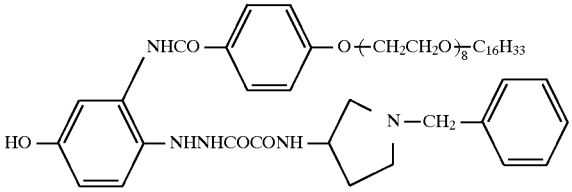
H-18
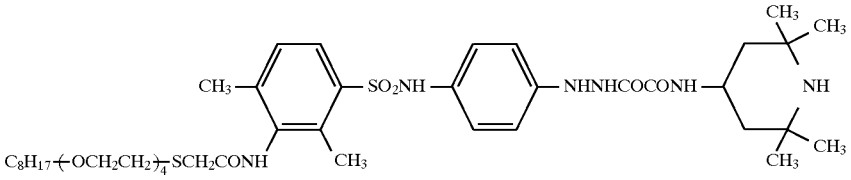
H-19
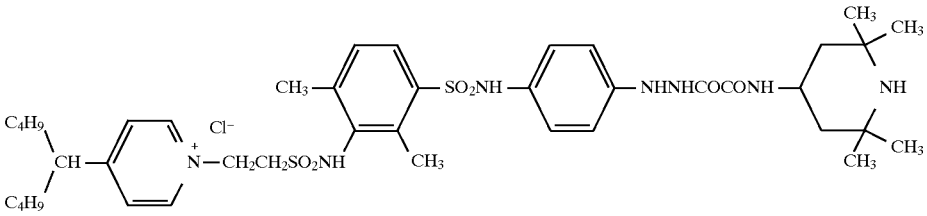

-continued

H-20

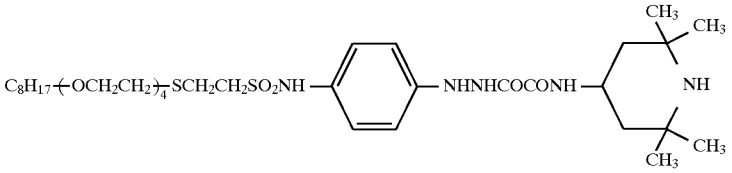

H-21

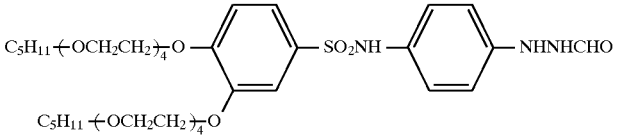

H-22

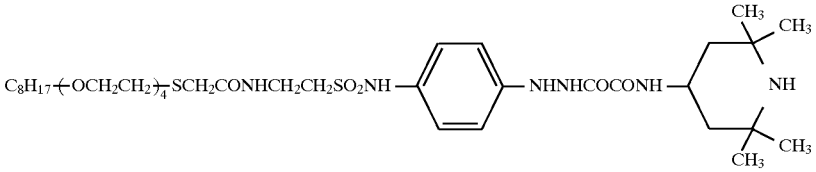

H-23

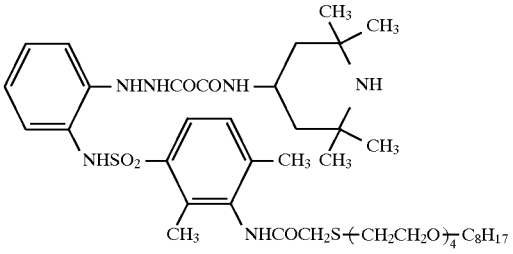

H-24

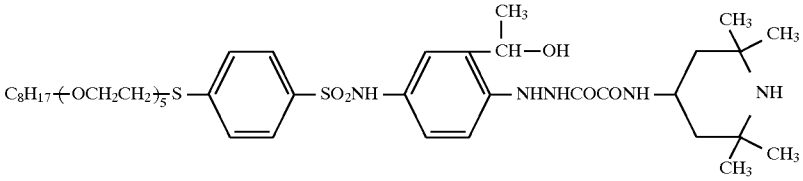

H-25

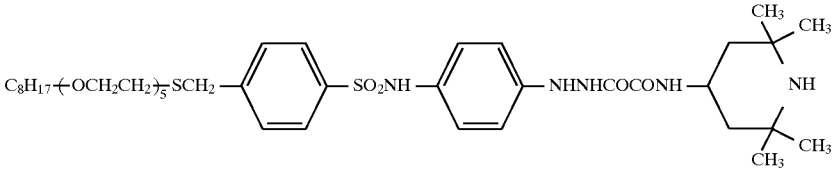

H-26

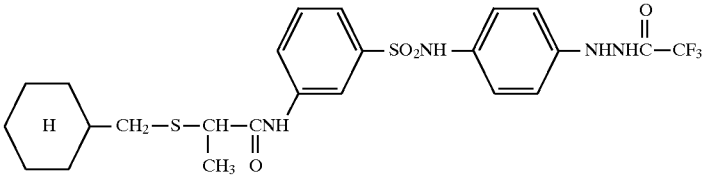

H-27

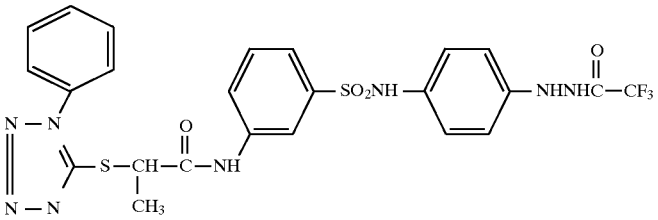

Although an addition amount of the hydrazine compound depends on the size or halide composition of silver halide grains, an extent of chemical sensitization and the kind of a restraining agent, the amount is preferably $10^{-6}$ to $10^{-1}$, more preferably, $10^{-5}$ to $10^{-2}$ mol per mol of silver halide. In the invention, three or more kinds of the hydrazine compounds may be contained in any layers.

In the invention, there maybe contained a hydrazine compound capable of releasing a development inhibitor upon hydrolysis, as disclosed in Japanese Patent Application No. 6-160196. A redox compound capable of releasing a development inhibitor upon oxidation, represented by the following formulas (1) to (6) is preferably contained in a hydrophilic colloidal layer.

Examples of the compound represented by formulas (1) to (6) are shown as below, but embodiments of the present invention are not limited thereto.

Formula (1)

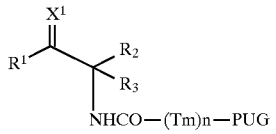

Formula (2)

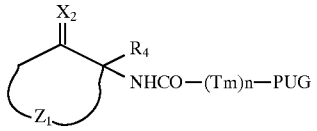

Formula (3)

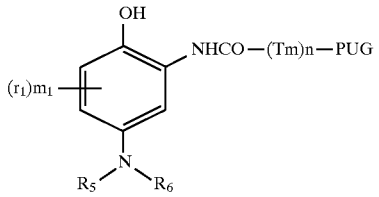

Formula (4)

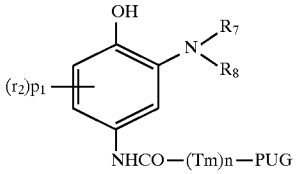

Formula (5)

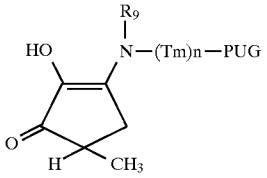

Formula (6)

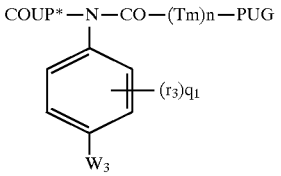

Formula (Coup-1)

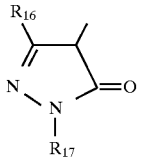

Formula (Coup-2)

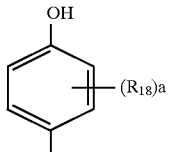

-continued

Formula (Coup-3)

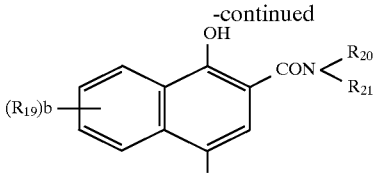

Formula (Coup-4)

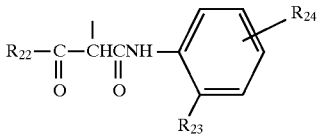

Formula (Coup-5)

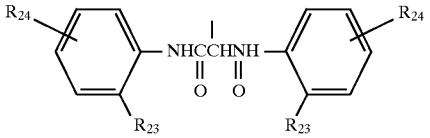

Formula (Coup-6)

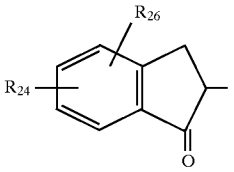

Formula (Coup-7)

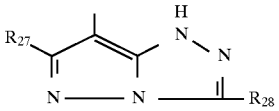

Formula (Coup-8)

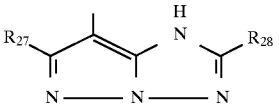

The compound represented by formulas (1) to (6) will be explained more in detail. $R_1$, $R_8$ and $R_9$ each are an alkyl group, aryl group or heterocyclic group, and preferably, a methyl group, p-methoxyphenyl group or pyridyl group. $R_6$ and $R_7$ each are an acyl group, carbamoyl group, cyano group, nitro group, sulfonyl group, aryl group, oxalyl group, heterocyclic group, alkoxycarbonyl group or aryloxycarbonyl group, and preferably, an acyl, carbamoyl group or cyano group. These group each have preferably 1 to 20 carbon atoms. The groups, $R_1$ to $R_9$ may be substituted. As examples of substituents are cited a halogen atom such as chlorine or bromine; alkyl group such as methyl, ethyl, isopropyl, hydroxyethyl, methoxyethyl, trifluoromethyl or t-butyl; cycloalkyl group such as cyclopentyl or cyclohexyl; alalkyl group such as benzyl or 2-phenethyl; aryl group such as phenyl, naphthyl, p-tolyl or p-chlorophenyl; alkoxy group such as methoxy, ethoxy, isopropoxy or n-butoxy; aryloxy group such as pheoxy; cyano group; acylamino group such as acetylamino or propionylamino; alkylthio group such as methylthio, ethylthio or n-butylthio; arylthio group such as phenylthio; sulfonylamino group such as methanesulfonylamino or benzenesulfonylamino; ureido group such as 3-methylureido, 3,3-dimethylureido or 1,3-dimethylureido; sulfamoylamino group such as dimethylsufamoylamino; carbamoyl group such as methylcarbamoyl, ethylcarbamoyl or dimethylcarbamoyl; sulfamoyl group such as ethylsulfamoyl or dimethylsulfamoyl; alkoxycarbonyl group such as methoxycarbonyl or ethoxycarbonyl; aryloxycarbonyl group such as phenoxycarbonyl; sulfonyl group such as methanesulfonyl, butanesulfonyl or phenylsulfonyl; acyl group such as acetyl, propanoyl or butyloyl; amino group such as methylamino, ethylamino group or dimethylamino;

hydroxy group; imido group such as phthalimido; and heterocyclic group such as pyridyl, benzimidazolyl, benzthiazolyl or benzoxazolyl.

"Coup" represents a coupler residue. As a cyan coupler residue is cited a phenol coupler or naphthol coupler; as a magenta coupler is cited 5-pyrazolone, pyrazolone coupler, cyanoacetylcoumarone coupler, open-chained acylacetonitrile coupler or indazolone coupler. As a yellow coupler residue is cited a benzoylacetoanilide coupler, pivaloylacetoanilide coupler or malonic-dianilide coupler. As a non-dye forming coupler is cited a open-chained or cyclic active methylene compound such as indanone, cyclopentanone, malonic diester, imidazoline, oxazolinone or thiazolinone. Coup is preferably represented by formulas (Coup-1) to (Coup-8).

In the formula, $R_{16}$ represents a halogen atom, acylamido group, alkoxycarbonylamido group, sulfoureido group, alkoxy group, alkylthio group, hydroxy group or aliphatic group; $R_{20}$ and $R_{21}$ each represent an aliphatic group, aromatic group or heterocyclic group and one of $R_{20}$ and $R_{21}$ may be a hydrogen atom; a is an integer of 1 to 4; b is an integer of 0 to 5, and when a or b is 2 or more, $R_{19}$ may be the same or different from each other.

In the formula, $R_{22}$ represents a tertiary alkyl group or aromatic group; $R_{23}$ represents a hydrogen atom, halogen atom or alkoxy group; $R_2$ represents an acylamido group, aliphatic group, alkoxycarbonyl group, sulfamoyl group, carbamoyl group, alkoxy group, halogen atom or sulfonamido group.

In the formula, $R_{25}$ represents an aliphatic group, alkoxy group, acylamino group, sulfonamido group, sulfamoyl group or diacylamino group; $R_{26}$ represents a hydrogen atom, halogen atom or nitro group.

$R_{27}$ and $R_{28}$ each represent a hydrogen atom, aliphatic group, aromatic group or heterocyclic group.

$Z_1$ represents a 5- or 6-membered heterocyclic ring having at least one of O, S and N, which may be monocyclic or a condensed ring, and may also be substituted. As a substituent thereof is cited one afore-described.

"Tm" represents a timing group including —$OCH_2$— or a bivalent timing group as described in U.S. Pat. Nos. 4,248,962, 4,409,328 and 3,674,478, Research Disclosure 21228 (Dec., 1981), JP-A 57-56837 and 4-438.

"PUG" represents a photographically useful group including a developer inhibitor as described in U.S. Pat. No. 4,477,563, JP-A 60-218644, 60-221750, 60-233650 and 61-11743.

Tm-1 Tm-2 Tm-3

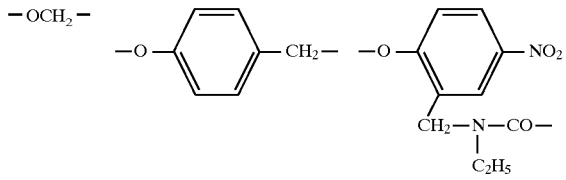

n = 1 n = 1 n = 1

Tm-4 Tm-5 Tm-6

-continued

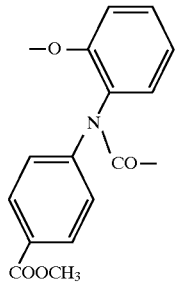

n = 1

PUG1

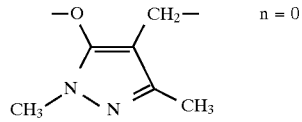

n = 0 n = 1

PUG2

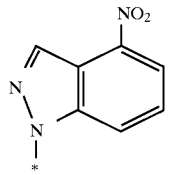

PUG3

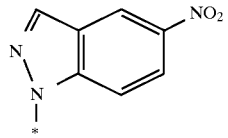

PUG4

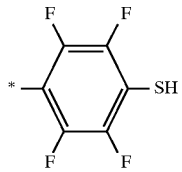

PUG5

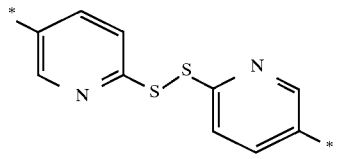

PUG6

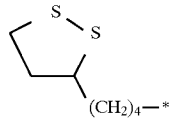

PUG7

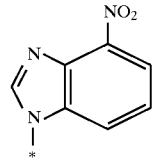

PUG8

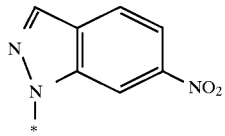

PUG9

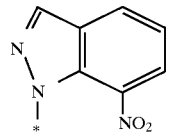

PUG10

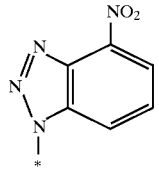

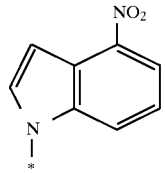

*: Bonding position

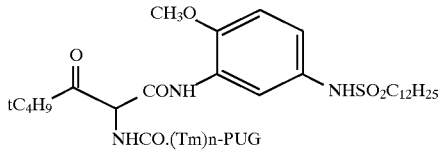

-continued
| Compound No. | PUG | Tm |
|---|---|---|
| T-1 | 1 | 6 |
| T-2 | 3 | 6 |
| T-3 | 4 | 2 |
| T-4 | 6 | 2 |
| T-5 | 7 | 3 |
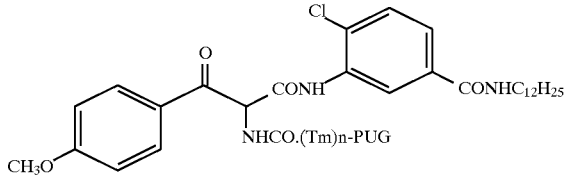
| Compound No. | PUG | Tm |
|---|---|---|
| T-6 | 1 | 6 |
| T-7 | 2 | 6 |
| T-8 | 3 | 1 |
| T-9 | 5 | 1 |
| T-10 | 8 | 2 |
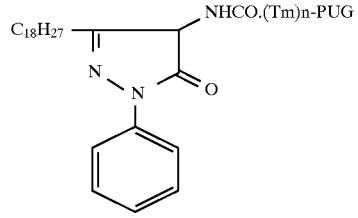
| Compound No. | PUG | Tm |
|---|---|---|
| T-11 | 1 | 6 |
| T-12 | 3 | 6 |
| T-13 | 4 | 1 |
| T-14 | 7 | 2 |
| T-15 | 10 | 4 |
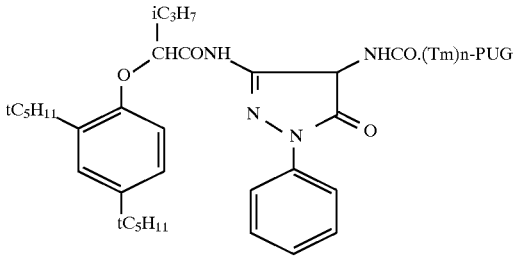
| Compound No. | PUG | Tm |
|---|---|---|
| T-16 | 1 | 6 |
| T-17 | 3 | 6 |
| T-18 | 4 | 1 |
| T-19 | 8 | 2 |
| T-20 | 9 | 5 |
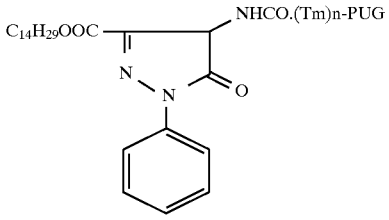
-continued
| Compound No. | PUG | Tm |
|---|---|---|
| T-21 | 1 | 6 |
| T-22 | 3 | 1 |
| T-23 | 4 | 2 |
| T-24 | 7 | 4 |
| T-25 | 9 | 5 |
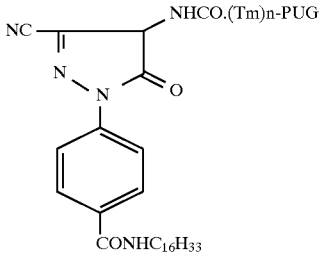
| Compound No. | PUG | Tm |
|---|---|---|
| T-26 | 1 | 6 |
| T-27 | 4 | 6 |
| T-28 | 5 | 2 |
| T-29 | 6 | 4 |
| T-30 | 8 | 5 |
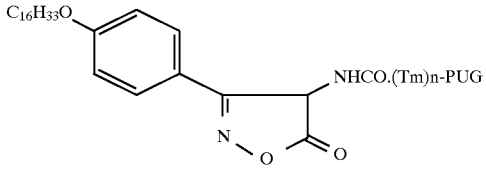
| Compound No. | PUG | Tm |
|---|---|---|
| T-31 | 2 | 6 |
| T-32 | 4 | 6 |
| T-33 | 8 | 1 |
| T-34 | 9 | 2 |
| T-35 | 10 | 5 |
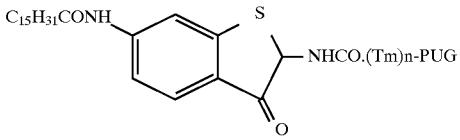
| Compound No. | PUG | Tm |
|---|---|---|
| T-36 | 2 | 6 |
| T-37 | 3 | 6 |
| T-38 | 6 | 4 |
| T-39 | 8 | 5 |
| T-40 | 10 | 1 |
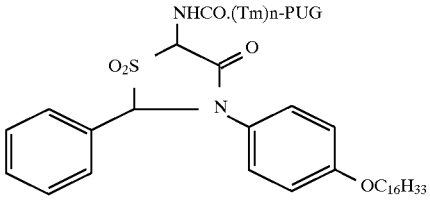
| Compound No. | PUG | Tm |
|---|---|---|
| T-41 | 1 | 6 |
| T-42 | 3 | 6 |

-continued
| | | |
|---|---|---|
| T-43 | 4 | 3 |
| T-44 | 7 | 4 |
| T-45 | 8 | 2 |
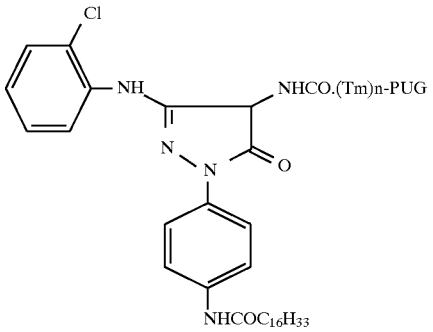
| Compound No. | PUG | Tm |
|---|---|---|
| T-46 | 1 | 6 |
| T-47 | 2 | 1 |
| T-48 | 4 | 2 |
| T-49 | 6 | 4 |
| T-50 | 9 | 5 |
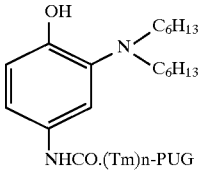
| Compound No. | PUG | Tm |
|---|---|---|
| T-51 | 1 | 6 |
| T-52 | 3 | 6 |
| T-53 | 4 | 2 |
| T-54 | 6 | 2 |
| T-55 | 7 | 3 |
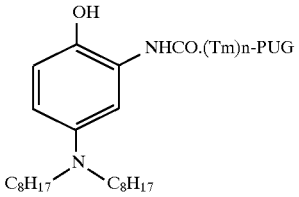
| Compound No. | PUG | Tm |
|---|---|---|
| T-56 | 1 | 6 |
| T-57 | 2 | 6 |
| T-58 | 3 | 1 |
| T-59 | 5 | 1 |
| T-60 | 8 | 2 |
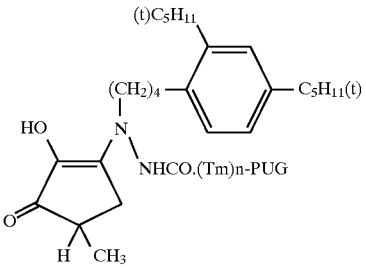
-continued
| Compound No. | PUG | Tm |
|---|---|---|
| T-61 | 1 | 6 |
| T-62 | 3 | 6 |
| T-63 | 4 | 1 |
| T-64 | 7 | 2 |
| T-65 | 10 | 4 |
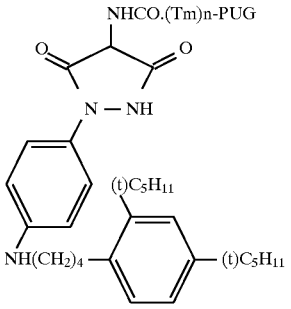
| Compound No. | PUG | Tm |
|---|---|---|
| T-66 | 1 | 6 |
| T-67 | 3 | 6 |
| T-68 | 4 | 1 |
| T-69 | 8 | 2 |
| T-70 | 9 | 5 |
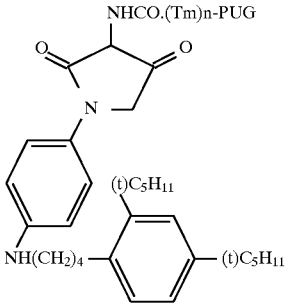
| Compound No. | PUG | Tm |
|---|---|---|
| T-71 | 1 | 6 |
| T-72 | 3 | 1 |
| T-73 | 4 | 2 |
| T-74 | 7 | 4 |
| T-75 | 9 | 5 |
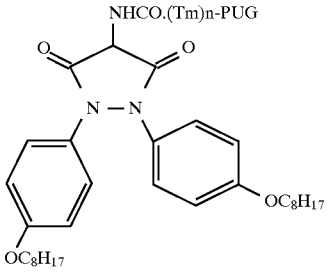
| Compound No. | PUG | Tm |
|---|---|---|
| T-76 | 1 | 6 |
| T-77 | 4 | 6 |
| T-78 | 5 | 6 |
| T-79 | 6 | 4 |
| T-80 | 8 | 5 |

-continued
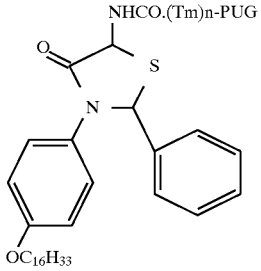
| Compound No. | PUG | Tm |
|---|---|---|
| T-81 | 2 | 6 |
| T-82 | 4 | 6 |
| T-83 | 8 | 1 |
| T-84 | 9 | 2 |
| T-85 | 10 | 5 |
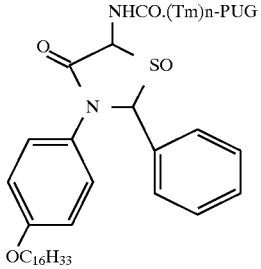
| Compound No. | PUG | Tm |
|---|---|---|
| T-86 | 2 | 6 |
| T-87 | 3 | 6 |
| T-88 | 6 | 4 |
| T-89 | 8 | 5 |
| T-90 | 10 | 1 |
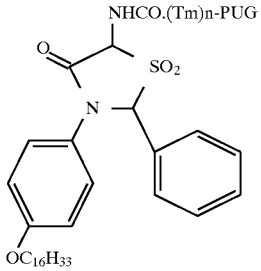
| Compound No. | PUG | Tm |
|---|---|---|
| T-91 | 1 | 6 |
| T-92 | 3 | 6 |
| T-93 | 4 | 3 |
| T-94 | 7 | 4 |
| T-95 | 8 | 2 |
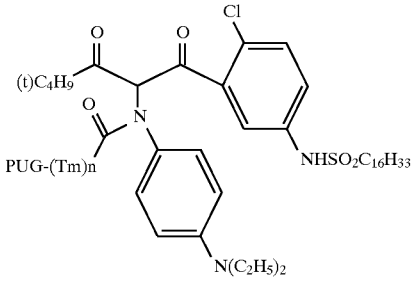
-continued
| Compound No. | PUG | Tm |
|---|---|---|
| T-96 | 1 | 6 |
| T-97 | 2 | 1 |
| T-98 | 4 | 2 |
| T-99 | 6 | 4 |
| T-100 | 9 | 5 |
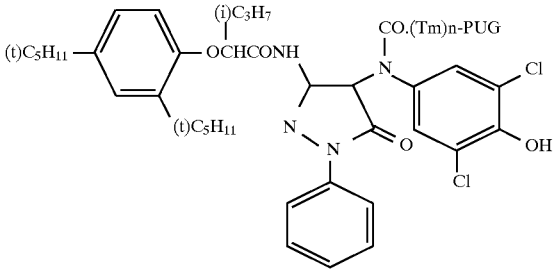
| Compound No. | PUG | Tm |
|---|---|---|
| T-101 | 2 | 6 |
| T-102 | 3 | 6 |
| T-103 | 4 | 3 |
| T-104 | 5 | 4 |
| T-105 | 9 | 5 |
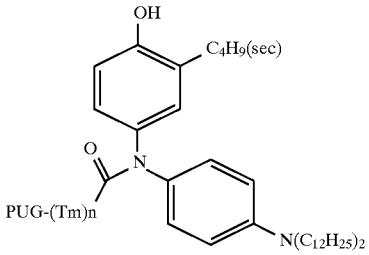
| Compound No. | PUG | Tm |
|---|---|---|
| T-106 | 3 | 6 |
| T-107 | 6 | 6 |
| T-108 | 5 | 3 |
| T-109 | 8 | 4 |
| T-110 | 10 | 2 |
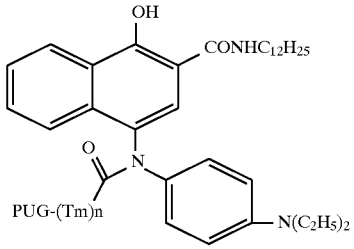
| Compound No. | PUG | Tm |
|---|---|---|
| T-111 | 1 | 6 |
| T-112 | 3 | 6 |
| T-113 | 4 | 1 |
| T-114 | 8 | 1 |
| T-115 | 10 | 3 |

-continued

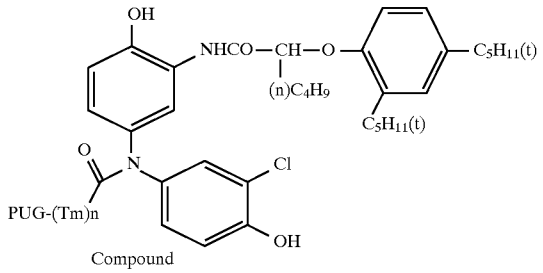

| Compound No. | PUG | Tm |
|---|---|---|
| T-116 | 1 | 6 |
| T-117 | 3 | 6 |
| T-118 | 4 | 1 |
| T-119 | 5 | 2 |
| T-120 | 6 | 3 |

The compound represented by formula (1) to (6) is contained in an amount of $1.0\times10^{-2}$ to $1.0\times10^{-2}$ mol/m$^2$, preferably, $1.0\times10^{7}$ to $1.0\times10^{-4}$ mol/m$^2$.

The compound used in the invention may be dissolved in a water-miscible organic solvent such as alcohols, ketones, dimethylsulfoxide, dimethylformamide or methyl cellosolve. The compound may be added in the form of a emulsified dispersion using a known oil. Further, according to a method known as a solid particle dispersion, the compound in the form of powder is dispersed in water using a ball mill, colloid mill, impeller dispersing machine or ultrasonic homogenizer.

In the present invention, well-known sulfur sensitization, reduction sensitization, noble metal sensitization and a chemical sensitization with a Se- or Te-compound may be applied.

As a sulfur sensitizer may be used various sulfur compounds including thiosulfates, thioureas, rhodanines polysulfides, besides a sulfur compound contained in gelatin.

As a representative noble metal sensitization is cited gold sensitization, in which a gold complex compound, as a gold compound is used. Besides gold, a complex of noble metals such as platinum, palladium and rhodium may be usable.

As a reduction sensitizer, stannous salt, amines, formamidinesulfinic acid and silane compounds are usable.

Silver halides used in the present invention include silver chloride, silver bromochloride containing 60 mol % or more chloride, or silver iodobromochloride containing 60 mol % or more chloride.

The average grain size of silver halide grains used in the invention is preferably 0.7 $\mu$m or less, more preferably, 0.1 to 0.5 $\mu$m. The word, "grain size" refers to a diameter of the grain, in the case where it is in the form of a sphere or close thereto. In the case where the grain is cubic, the size refers to a diameter of a sphere having a volume identical to the cube. A method for determining the average grain size is referred to C. E. K. Mees & T. H. James, The Theory of the Photographic Process, 3rd ed., pages 36–43 (1966. Macmillan).

Shapes of the silver halide grains are not limitative, which are tabular, spherical, cubic, tetradecahedral, octahedral or any other form. Narrow grain-size spread is preferable. Monodispersed emulsion in which grain sizes of 90% or more (preferably 95% or more) of the total grains are within a range of the average grain size ±40% thereof.

The manner in which a water soluble silver salt and a water soluble halide react with each other may be any of a single jet mixing method, simultaneously mixing method and combination thereof.

The silver halide grains may be formed in excess of silver ions (so-called reverse mixing method) . As one mode of the simultaneously mixing method, there may be employed a controlled double jet method, in which the reaction mixture for forming silver halide grains is maintained at a given pAg to thereby form regular-formed, monodispersed silver halide grains.

In the silver halide emulsion used in the present invention, it is preferable to incorporate a cadmium salt, zinc salt, lead salt, thallium salt, iridium salt, rhodium salt, ruthenium salt, osmium salt or complexes thereof during the course of forming nucleus grains or causing them to grow.

Silver halide emulsions and preparation methods thereof refer to Research Disclosure 176, 17643 pages 22–23 (Dec., 1978).

In the present invention, it is preferred to employ a nucleation accelerating agent, as represented by formula (Na) or (Nb) to promote contrast-increase.

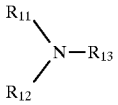

Formula (Na)

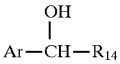

Formula (Nb)

In formula (Na), $R_{11}$, $R_{12}$ and $R_{13}$ represents a hydrogen atom, substituted or unsubstituted alkyl group, substituted or unsubstituted alkenyl group, alkynyl group, substituted or unsubstituted aryl group. $R_{11}$, $R_{12}$ and $R_{13}$ may be combined with each other to form a ring. A preferable nucleation accelerating agent is an aliphatic tertiary amine compound. The compound has preferably a ballast group or a group capable of adsorbing to silver halide. To be diffusion-proofing, the compound has preferably a molecular weight of 100 or more, preferably 300 or more. As the adsorbent group to silver halide are cited a heterocyclic group, mercapto group, thioether group, thione group and thiourea group.

Examples of the nucleation accelerating agent of formula (Na) are shown as below.

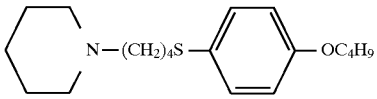

Na-1

$[(C_3H_7)_2N(CH_2)_3OCH_2CH_2]_2S$ Na-2

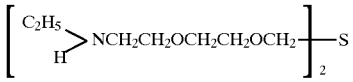

Na-3

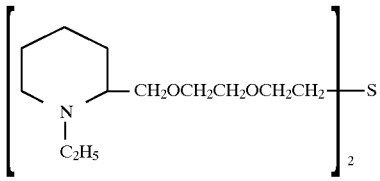

Na-4

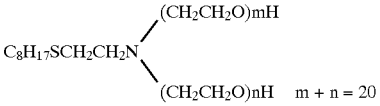

Na-5

-continued

Na-6

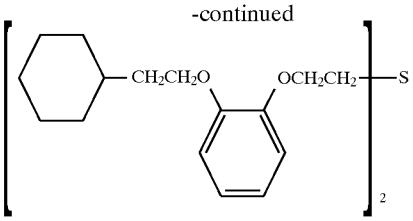

Na-7

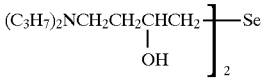

Na-8

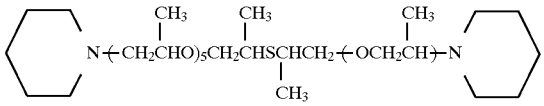

Na-9

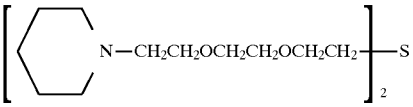

Na-10

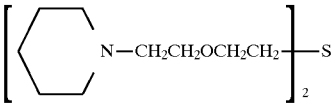

Na-11

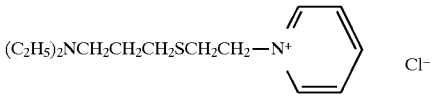

Na-12

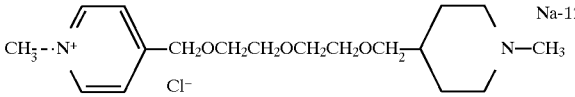

Na-13

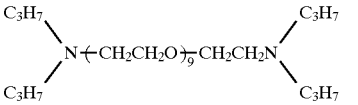

Na-14

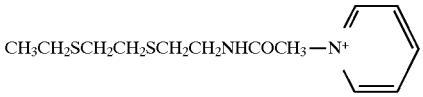

Na-15

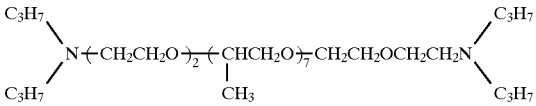

Na-16

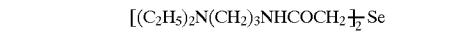

Na-17

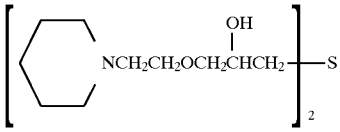

Na-18

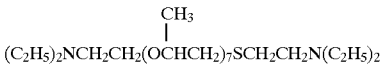

Na-19

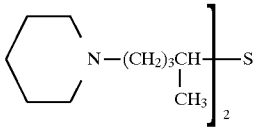

-continued

Na-20

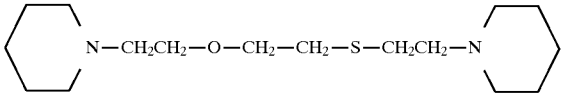

Na-21

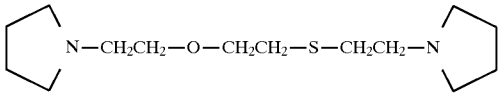

In formula (Nb), Ar represents an aromatic hydrocarbon group or heterocyclic group, each of which may be substituted. $R_{14}$ represents a hydrogen atom, alkyl group, alkynyl group, or aryl group. Ar and $R_{14}$ may be combined with each other to form a ring. The compound preferably has a ballast group or a group capable of adsorbing to silver halide. To be diffusion-proofing, the compound has preferably a molecular weight of 120 or more, preferably 300 or more. Preferable group capable of adsorbing to silver halide is the same as the adsorbent group contained in the compound of formula (Na).

Examples of the compounds represented by formula (Nb) are shown as below.

Nb-1

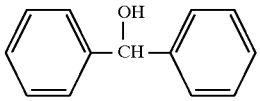

Nb-2

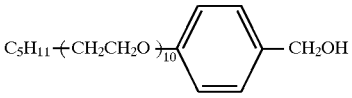

Nb-3

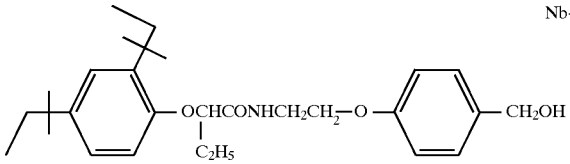

Nb-4

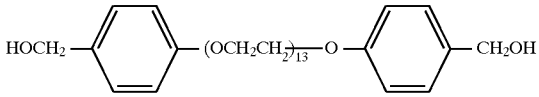

Nb-5

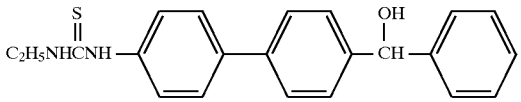

Nb-6

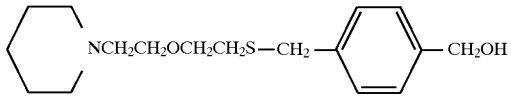

Nb-7

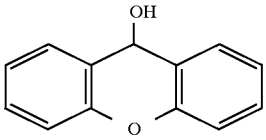

Nb-8

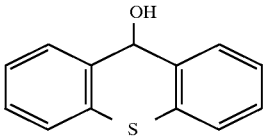

-continued

Nb-9

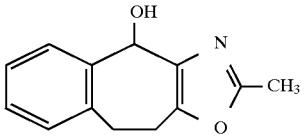

Nb-10

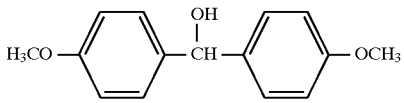

Nb-11

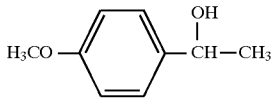

Nb-12

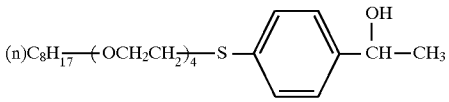

The hydrazine compound and nucleation accelerating agent used in the invention may be incorporated into any of the layers provided on the emulsion layer-side. These compounds are preferably incorporated in a silver halide emulsion layer or an adjacent layer thereto. The black-and-white photographic material of the present invention may be processed by using an automatic processor, in which a developer and fixer are replenished at a rate in proportion to the area of the photographic material to be processed. To lower the amount of the effluent, the developer replenishing rate and fixer replenishing rate each are 300 ml or less, preferably, 75 to 200 ml/m$^2$.

In view of the demand for shortening the processing time, the total processing time (dry to dry time) from the time when the top of a film is inserted into the processor to the time when the film is taken out of a drying zone is preferably 10 to 60 seconds. The total processing time refers to a total time necessary for processing the black-and-white photographic material, thus, the time of the total steps including developing, fixing, bleaching, washing, stabilizing and drying. In the case where the total processing time is 10 sec. or less, desensitization or contrast reduction occur, so that satisfactory photographic performance can be achieved. More preferably, the total processing time is 15 to 50 sec.

The automatic processor may be provided with a drying zone by means of a heat transfer body with a temperature of 90° C. or higher such as a heat roller with a temperature of 90° to 130° C. or an exothermic radiation body with a temperature of 150° C. or higher.

A silver halide emulsion used in the invention may be spectrally sensitized to a desired wavelength region with a sensitizing dye. Usable sensitizing dyes include a cyanine dye, merocyanine dye, complex cyanine dye, complex merocyanine dye, holopolar cyanine dye hemicyanine dye, styryl dye and hemioxonol dye. These dyes may have basic heterocyclic nuclei, such as a pyrroline nucleus, oxazoline nucleus, thiazoline nucleus, pyrrol nucleus, oxazole nucleus, thiazole nucleus, selenazole nucleus, imidazole nucleus, tetrazole nucleus, pyridine nucleus, these nuclei condensed with an alicyclic hydrocarbon ring, these nuclei condensed with an aromatic hydrocarbon ring such as indolenine nucleus, benzindolenine nucleus, indole nucleus, benzoxazole nucleus, naphthooxazole nucleus, benzthiazole nucleus, naphthothiazole nucleus, benzselenazole nucleus, bensimidazole nucleus and quinoline nucleus. These nuclei may be substituted. The merocyanine dye and complex merocyanine dye may have a nucleus having a ketomethylene structure such as a pyrazoline-5-one nucleus, thiohydantoin nucleus, 2-thiooxazoline-2,4-dione nucleus, rhodanine nucleus and thiobarbituric acid nucleus. These are described in Research Disclosure 176, 17643 (Dec., 1978), U.S. Pat. No. 4,425,425 and 4,425426. The sensitizing dye can be dissolved by means of ultrasonic vibration. A method for dissolving or dispersing the dye to add into an emulsion is described in U.S. Pat. No. 3,482,981, 3,585,195, 3,469,987, 3,425,835 and 3,342,605, 3,660,101 and 3,658,546, British Patent No. 1,271,329, 1,038,029 and 1,121,174. These dyes may be used singly or in combination thereof. The combined use of dyes is usable for the purpose of supersensitization. Effective supersensitive combination and supersensitizing materials are described in Research Disclosure 176, 17643 page 23 IV (Dec., 1978).

The photographic light sensitive material used in the invention may contain various compounds for the purpose of preventing fog occurred in the course of manufacturing or aging the photographic material or stabilizing photographic performance thereof. Thus, there may be added an antifoggant or stabilizer including azoles such as a benzthiazolium, nitroindazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles, mercaptotetrazoles (especially, 1-phenyl-5-mercaptotetrazole); mercaptopyrimidines, mercaptotriazines; thioketo compound such as oxazolinethione; azaindenes such as triazaindenes, tetrazaindenes (especially, 4-hydroxy-1,3,3a,7-tetrazaindenes), pentazaindenes; benzenethiosulfonic acid, benzenesulfininc acid, benzenesulfonic acid amide.

The silver halide emulsion or light-insensitive hydrophilic colloid used in the invention may contain an organic or inorganic hardener. Examples thereof include chromium salts such as chrome alum and chromium acetate, aldehydes such as formaldehyde, glyoxal and glutar aldehyde, N-methylol compound such as dimethylol urea and methylol dimethylhydantoin, dioxane derivatives such as 2,3-dihydroxydioxane, active vinyl compound such as 1,3,5-triacryloyl-hexahydro-s-triazinebis(vinylsulfonyl)methyl ether and N,N'-methylenebis-[β-(vinylsulfonyl) propioneimide], active halogen compound such as 2,4-dichloro-6-hydroxy-s-triazine, mucohalogen acid such as mucochloric acid and pheoxymucochloric acid, isooxazoles, dialdehyde starch, 2-chloro-6-hydroxytriazinyl gelatin. The hardener may be used singly or in combination thereof.

The silver halide emulsion or light-insensitive hydrophilic colloid used in the invention may contain various surfactant (s) for various purposes, including a coating aid, antistatic agent, sliding modifier, emulsion-dispersing agent, antisticking agent and photographic characteristic modifier.

Gelatin is advantageously employed as a binder or protective colloid. Other hydrophilic colloidal materials may be usable. Examples thereof include gelatin derivatives, a graft polymer of gelatin and another polymer, protein such as albumin and casein, cellulose derivatives such as hydroxyethylcellulose, carboxymethyl cellulose and cellulose sulfuric acid ester, sugar derivatives such as sodium alginate and starch derivative, and synthetic hydrophilic polymer compounds such as polyvinyl alcohol, polyvinyl alcohol partially acetal, poly-N-vinylpyrrolidone, polyacrylic acid, polymethacrylic acid, polyacrylamide, polyvinylimidazole, polyvinylpyrazole and copolymer of these polymers.

Besides lime-processed gelatin, there may be usable acid-processed gelatin, gelatin hydrolysate and gelatin-enzyme reaction product.

The silver halide emulsion used in the invention may contain a dispersion of water-insoluble or sparingly water-soluble polymer for the purpose of improving dimensional stability. Examples thereof include alkyl (metha) acrylate, alkoxyacryl (metha) acrylate, glycidyl(metha)acrylate, (metha)acrylamide, vinylester such as vinylacetate, acrylonitrile, olefin, styrene, copolymer thereof, and a polymer having, as a monomer component, a combination of afore-described monomers and such a monomer s acrylic acid, methacrylic acid, α, β-unsaturated dicarboxylic acid, hydroxyalkyl(metha)acrylate, sulfoalkyl(metha)acrylate and styrenesulfonic acid.

Other various additives may be used in the photographic light sensitive material of the invention. Examples thereof include desensitizer, plasticizer, sliding agent, development accelerating agent and oil.

With regard to additives, there may be usable compounds described in Research Disclosure 176 (afore-cited), page 22–31.

In the photographic light sensitive material of the invention, at least two hydrophilic colloid layers are provided on one side of a support. One or more light insensitive hydrophilic colloid layers are provided. In the case of two or more layers, there may be provided a protective layer, an interlayer between two emulsion layers or between an emulsion layer nearest to the support and the support.

In the photographic light sensitive material of the invention, a photographic emulsion layer or other layer is coated on one-side or both sides of a flexible support conventionally used. The flexible support is a film comprised of a synthetic polymer, including cellulose acetate, cellulose butyloacetate, polystyrene, polyethylene terephthalate.

The inventive photographic light sensitive material may contain various kinds of dyes for the purpose of improving safelight handling. As preferred dyes are cited dyes described in Japanese Patent Application No.6-160196, which are represented by formulas (1) to (6).

These dyes have at least one dissociative proton, exhibiting a pKa of 4 to 11, preferably, 4.5 to 7.0 in a water/ethanol solution (1:1 mixture by volume). The dye can be fixed by reacting the dye with a silver ion to form a silver salt or complex salt. As dyes capable of forming a dye-silver salt is cited compounds represented by Formulas [I} to [V], Formulas [I'] to [V'] and Formula [VI] as described in JP-A 5-181230, pages 4–28. As exemplary compounds thereof are cited I-1 to 37, II-1 to 5, III-1 to 7, IV-1 to 6, V-1 to 5, I'-1 to 12, II'-1 to 9, III'-1 to 9, IV'-1 to 9 and V'-1 to 52.

In the invention, a dispersing method of the dye represented by the above Formulas [I] to [VI] is not specifically limitative. There may be applied known methods such as an acid precipitating method, ball mill, jet mill and impeller dispersing method.

According to the invention, the average size of fine particles of a dye which are dispersed in the form of a solid particle dispersion is optional, preferably, 0.01 to 20 μm; more preferably, 0.03 to 2 μm. A coefficient of variation of the particle size of the dye fine particles is preferably 60% or less, more preferably 40% or less.

A layer containing the dye fine particles is provided between an emulsion layer and a support. Preferably, a first sublayer is provided on the support and further thereon provided with a hydrophilic colloidal, second sublayer containing the dye fine particles. The content of the dye particles is not limitative but preferable such an amount that gives an effective transmission density of 0.3 to 2.0.

The coating weight of the hydrophilic colloidal layer containing the fine dye particles is not less than 0.05 g/m$^2$ and less than 0.5 g/m$^2$ not less than 0.18 g/m$^2$ and less than 0.42 g/m$^2$. To enhance the inventive effects, a ratio of the average size of the dye particles to a layer thickness is preferably 0.2 to 2.0.

Developing agents used in the invention include dihydroxybenzenes such as hydroquinone, chlorohydroquinone, bromohydroquinone, 2,3-dichlorohydroquinone, methylhydroquinone, isopropylhydroquinone and 2,5-dimethylhydroquinone; 3-pyrazolidones such as 1-phenyl-3-pyrazolidone, 1-phenyl-4methyl-3-pyrazolidone1-phenyl-4,4-dimethyl-3-pyraolidone1-phenyl-4-ethyl-3-pyrazolidone and 1-phenyl-5-methyl-3-pyrazolidone; aminophenols such as o-aminophenol, p-aminophenol, N-methyl—p-aminophenol and 2,4-diaminophenol; pyrogallol; ascorbic acid; 1-aryl-3-pyrazolines such as 1-(p-hydroxyphenyl)-3-aminopyrazoline, 1-(p-aminophenyl)-3-aminopyrazoline and 1-(p-amino-N-methyphenyl)-3-aminopyrazoline; and transition metal complex salts. (These are a complex salt of a transition metal such as Ti, V, Cr, Mn, Fe, Co, Ni and Cu, which take a form with reducing, such as a form of a complex salt of $Ti^{3+}$, $V^{2+}$, $Cr^{2+}$ and $Fe^{2+}$. As a ligand are cited an aminopolycarboxylic acid such as ethylenediaminetetraacetic acid (EDTA) and diethylenetriaminepentaacetic acid (DTPA), and polyphosphoric acid such as hexamethapolyphosphoric acid and tetrapolyphosphoric acid.) These developing agent may be used singly or in combination thereof. A combination of 3-pyrazolidones and dihydroxybenzenes, a combination of aminophenols and dihydroxybenzenes, a combination of 3-pyrazolidones and ascorbic acid, a combination of aminophenols and ascorbic acid, a combination of 3-pyrazolidones and transition metal salts, and a combination of aminophenols and transition metal salts are preferable. The developing agent is preferably used in an amount of 0.01 to 1.4 mol/l.

As antisludging agent usable in the invention are cited compounds described in Japanese Patent examined No. 60-4702, JP-A 3-51844, 4-26838, 4-362942 and 1-319031.

Waste developer liquor can be rejuvenated through electrolysis. Thus, a cathode (e.g. , a conductor such as stainless wool or semiconductor) is put into the waste developer liquor and an anode (e.g., an insoluble conductor such as carbon, gold, platinum and titanium) is put into an electrolytic solution in such a manner that a developer waste liquor is, through an anion exchange membrane, in contact with a electrolytic solution. The rejuvenation is conducted by energizing both electrodes. The photographic material can be processed while the waste liquor is being rejuvenating. Various additives to the developer, such as a preservative, alkali, pH buffer, sensitizing agent, antifoggant and antisludging agent may be introduced at that time. The photographic material can be developed while energizing the developer, in which the above additives may be added into the developer. In the case where the waste developer liquor is rejuvenated for reuse, a developing agent is preferably a transition metal complex salt.

The preservatives usable in the invention is preferably a sulfite or metabisulfite, such as sodium sulfite, potassium sulfite, ammonium sulfite and sodium metabisulfite. The sulfite is added preferably in an amount of not less than 0.25 mol/l, more preferably not less than 0.4 mol/l.

The developer may contain an alkali (e.g., sodium hydroxide, potassium hydroxide), pH buffer (e.g., a carbonate, phosphate, borate, boric acid, citric acid, alkanolamine), dissolving aid (e.g., polyethylene glycols, ester thereof, alkanolamine), sensitizing agent (e.g., nonionic surfactants including polyoxyethylenes, quaternary ammonium compounds), surfactant, deforming agent, antifoggant (e.g., halides such as potassium bromide and sodium bromide, nitrobenzindazole, nitrobenzimidazole, benztriazole, benzthiazole, tetrazoles, thiazoles)cheating agent (e.g., ethylenediaminetetraacetic acid and an alkali salt metal thereof, nitrilotriacetate, polyphosphate), development accelerating agent (e.g., compounds described in U.S. Pat. No. 2,304,025, Japanese Patent examined No. 47-45541), hardener (e.g., glutar aldehyde, bisulfite adduct thereof). The pH of the developer is preferably 8.5 to 10.5 so that the total processing time (Dry to Dry) is within 60 sec.

The photographic light sensitive material of the invention may be subjected to an activator processing. As a specific mode of development processing, a developing agent is contained in the emulsion layer of a photographic material, which is processed in an alkali solution to be developed. A combination of this development with stabilization processing with a thiocyanate has been employed as one of rapid processing methods. In such rapid processing, inventive effects are remarkably displayed.

A fixer may contain conventional constituents. The fixer is an aqueous solution comprising a fixing agent and other constituents. The pH thereof is within a range of 3.8 to 5.8. As the fixing agent is employed a thiosulfate such as sodium thiosulfate, potassium thiosulfate and ammonium thiosulfate; thiocyanate such as sodium thiocyanate, potassium thiocyanate and ammonium thiocyanate; and organic sulfur compound capable of forming a stable, water-soluble silver complex.

The fixer may contain, as a hardener, a water-soluble aluminum salt, such as aluminum chloride, aluminum sulfate and potassium alum.

The fixer may contain optionally a preservative (e.g., sulfite, bisulfite), pH buffer (e.g., acetic acid), pH adjusting agent (e.g., sulfuric acid) and chelating agent having water softening ability.

The developer may be a mixture of solid components, an organic aqueous solution containing a glycol or amine, or a viscous fluid in a paste form.

The development temperature may be set within a conventional range of 20° to 30° C. or within a higher range of 30° to 40° C.

EXAMPLES

Embodiments of the present invention will be exemplarily explained as follows, but the invention is not limited thereto.

Example 1

Preparation of silver halide emulsion (A1):

Silver bromochloride core grains containing 95 mol % chlorideand having an average size of 0.15 $\mu$m was prepared by a double jet method. During the course of forming the core grains, there were added $K_3Rh(NO)_4(H_2o)_2$ of $8\times10^{-8}$ mol per mol of silver and $K_3OsCl_6$ of $8\times10^{-6}$ mol per mol of silver. The core grains were further covered with a shell by a double jet method. During the course of forming the shell, there were added $K_2IrCl_6$ of $3\times10^{-7}$/Ag mol and thallium nitrate of $3\times10^{-7}$ mol/Ag mol. Silver iodide fine grains were further added thereto to form an emulsion comprising monodispersed (variation coefficient of 10%), silver iodobromochloride cubic grains containing 90 mol % chloride and having an average size of 0.2 $\mu$m and containing 90 mol % chloride and 0.2 mol % iodide. The emulsion was desalted using a modified gelatin described in JP-A 2-280139 (phenylcarbamoyl gelatin, in which an amino group contained in the gelatin was substituted by phenylcarbamyl, e.g., G-8 compound exemplified in JP-A 2-280139). After desalting, the EAg of the emulsion was proved to be 190 mV at 50° C.

To the resulting emulsion was added 4-hydroxy-6-methyl-1,3,3a,7-tetrazaindene of $1\times10^{-3}$ mol/Ag mol. After adding thereto potassium bromide and citric acid to adjust the pH and EAg to 5.6 and 123 mV, respectively and further adding sodium p-toluenethiosulfonate of $1\times10^{-3}$ mol/Ag mol, the emulsion was chemically ripened at 60° C. by adding sulfur compounds. After completing the ripening, there were added 4-hydroxy-6-methyl-1,3,3a,7-tetrazaindene of $2\times10^{-3}$ mol/Ag mol, 1-phenyl-5- mercaptotetrazole of $3\times10^{-4}$ mol/Ag mol and gelatin, then, potassium iodide of 300 mg/Ag mol was further added.

Preparation of silver halide emulsions (A2, A3):

Silver halide emulsions A2 and A3 were prepared in the same manner as the silver halide emulsion A1, except that the addition amount of the Rh complex salt was changed to $9\times10^{-8}$ and $10\times10^{-8}$ mol/Ag mol, respectively.

Preparation of silver halide photographic light sensitive material for use in plate-making scanner, containing a hydrazine compound:

On a support were simultaneously coated, in the following order, a gelatin sublayer of formula 1 in a gelatin amount of 0.5 g/m$^2$, a silver halide emulsion layer (1) of formula 2 in silver and gelatin amounts of 2.0 and 1.0 g/m$^2$, respectively; an interlayer of formula 3 in a gelatin amount of 0.3 g/m$^2$, another silver halide emulsion layer (2) of formula 4 in silver and gelatin amounts of 0.8 and 0.4 g/m$^2$ respectively; and a protective layer of formula 5 in a gelatin amount of 0.6 g/m$^2$. On a sublayer of the opposite side of the support were simultaneously coated, in the following order, a backing layer of formula 6 in a gelatin amount of 0.6 g/m$^2$; a polymer layer of formula 7; and a backing protective layer of formula 8 in a gelatin amount of 0.4 g/m$^2$. The emulsion-side layers and backing layers were simultaneously coated by curtain coating method at a speed of 200 m/min.

| Formula 1 (Gelatin sublayer composition) | |
|---|---|
| Gelatin | 0.5 g/m$^2$ |
| Dye a (powder, average particle size of 0.1 mm) | 25 mg/m$^2$ |
| Dye b* | 20 mg/m$^2$ |
| Sodium polystyrenesulfonate (Mw. 500,000) | 10 mg/m$^2$ |
| Redox compound RE-1 | 50 mg/m$^2$ |
| S-1 (Sodium i-amyl-n-decysulfosuccinate) | 0.4 mg/m$^2$ |
| **Formula 2 (Silver halide emulsion layer-1 composition)** | |
| Silver halide emulsion A1 or A2 (Table 1) | 2.0 g/m$^2$ |
| Sensitizing dye d-1 | 6 mg/m$^2$ |
| Sensitizing dye d-2 | 3 mg/m$^2$ |
| Hydrazine compound, as shown in Table 1 (methanol solution) | $2\times10^3$ mol/Ag mol |
| Amine compound AM-1 | 40 mg/m$^2$ |
| Compound e | 100 mg/m$^2$ |
| Polymer latex f | 1.0 g/m$^2$ |
| Hardener g | 5 mg/m$^2$ |
| S-1 | 0.7 mg/m$^2$ |
| Saponin | 20 mg/m$^2$ |
| 2-Mercapto-6-hydroxypurine | 10 mg/m$^2$ |
| Dye b | 20 mg/m$^2$ |
| Ascorbic acid | 20 mg/m$^2$ |
| EDTA | 50 mg/m$^2$ |
| Sodium polystyrenesulfonate | 10 mg/m$^2$ |
| **Formula 3 (Interlayer composition)** | |
| Gelatin | 0.3 g/m$^2$ |
| S-1 | 2 mg/m$^2$ |
| Sodium polystyrenesulfonate | 10 mg/m$^2$ |
| Polyer latex (JP-A 4-359245, Example 1) | 0.3 mg/m$^2$ |
| **Formula 3 (Silver halide emulsion layer-2 composition)** | |
| Silver halide emulsion A1 (in silver amount) | 1.0 g/m$^2$ |
| Sensitizing dye d-1 | 0.5 mg/m$^2$ |

-continued

| | |
|---|---|
| Hydrazine compound H-8 | $2 \times 10^{-3}$ mol/Ag/mol |
| Amine compound AM-1 | 20 mg/m$^2$ |
| Redox compound RE-1 | 4 mg/m$^2$ |
| S-1 | 1.7 mg/m$^2$ |
| Styrene-maleic acid copolymer (Mw. 70,000) | 10 mg/m$^2$ |
| Phthalated gelatin was used, and the pH of a coating solution was 4.8. | |
| Formula 5 (Protective layer composition) | |
| Gelatin | 0.6 mg/m$^2$ |
| Dye c (powder, average particle size of 0.1 μm) | 40 mg/m$^2$ |
| S-1 | 12 mg/m$^2$ |
| Matting agent (polymethylmethacrylate, average particle size of 3.5 μm) | 25 mg/m$^2$ |
| Matting agent (amorphous silica, average particle size of 8 μm) | 12.5 mg/m$^2$ |
| 1,3-Vinylsufonyl-2-propanol | 40 mg/m$^2$ |
| Redox compound RE-1 | 4 mg/m$^2$ |
| Surfactant h | 1 mg/m$^2$ |
| Slipping agent (silicone oil) | 4 mg/m$^2$ |
| Colloidal silica (av. particle size 0.05 μm) | 20 mg/m$^2$ |
| Hardener j | 30 mg/m$^2$ |
| Sodium polystyrenesulfonate | 10 mg/m$^2$ |
| Formula 6 (Backing layer composition) | |
| Gelatin | 0.6 g/m$^2$ |
| S-1 | 5 mg/m$^2$ |
| Latex polymer f | 0.3 mg/m$^2$ |
| Colloidal silica (av. particle size 0.05 μm) | 70 mg/m$^2$ |
| Sodium polystyrene sulfonate | 10 mg/m$^2$ |
| Compound I | 100 mg/m$^2$ |
| Formula 7 (Polymer layer) | |
| Latex j (methylacrylate: acrylic acid = 97:3) | 1.0 g/m$^2$ |
| Hardener g | 6 mg/m$^2$ |
| Formula 8 (Backing protective layer) | |
| Gelatin | 0.4 g/m$^2$ |
| Matting agent (polymethylmethacrylate, average particle size of 3.5 μm) | 50 mg/m$^2$ |
| Sodium di-(2-ethylhexyl)-sulfonate | 10 mg/m$^2$ |
| Surfactant h | 1 mg/m$^2$ |
| Dye k | 20 mg/m$^2$ |
| $H—(OCH_2CH_2)_{68}OH$ | 50 mg/m$^2$ |
| Hardener g | 20 mg/m$^2$ |
| Sodium polystyrenesulfonate | 10 mg/m$^2$ |
| Zinc hydroxide | 50 mg/m$^2$ |

*: After dissolved in an alkali solution, the dye was precipitated from the solution by neutralizing with citric acid, average particle size of 0.08 μm.

Dye a

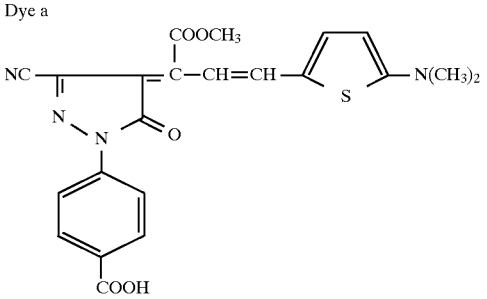

Dye b

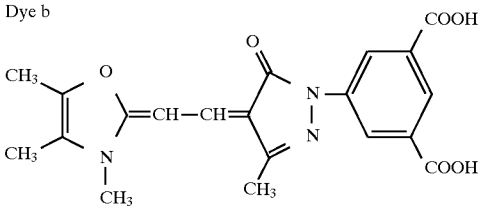

-continued

Dye c

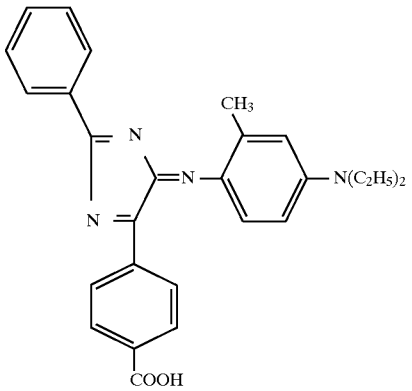

Dye e

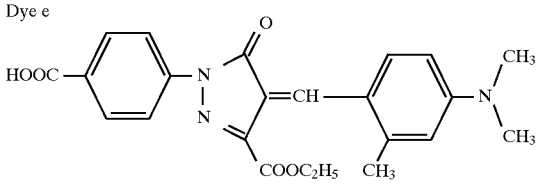

Dye k

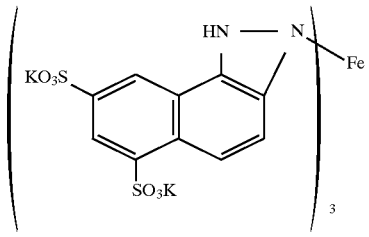

Amine compound AM-1

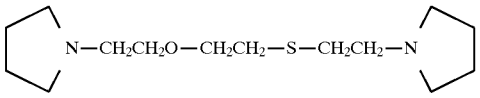

Sensitizing dye d-1

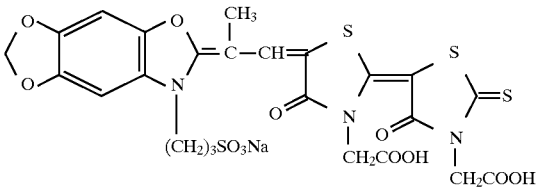

Sensitizing dye d-2

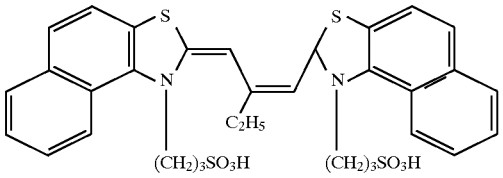

Compound e

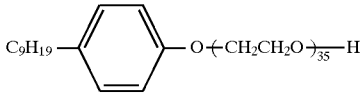

-continued

Latex polymer f

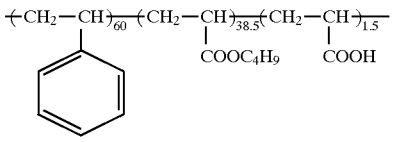

Hardener g

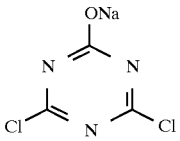

Hardener j

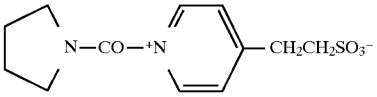

Surfactant h

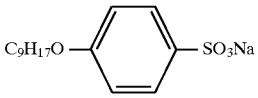

Compound I

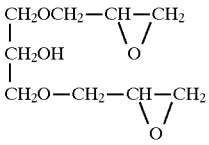

Redox compound RE-1

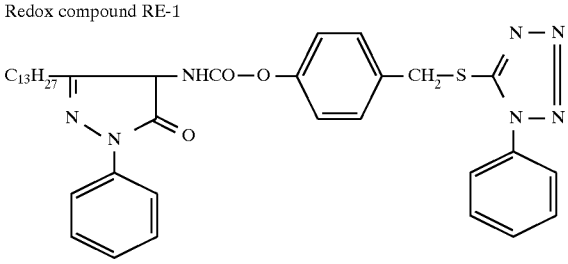

Thus prepared samples were exposed to a light source with a wavelength of 633 nm in place of He-Ne laser light and processed with a rapid processing type automatic processor (GR-26SR, product by Konica) using the following developer and fixer. Further, in order to make evaluation with respect to fine dot quality, the samples were exposed through random pattern halftone dots of 8 $\mu$m (FM screen) with SG-747RU produced by Dainihon Screen and processed in the same manner as above. Furthermore, the samples were subjected to running tests, in which 80% exposed films (20×22 inches) were processed at a replenishing rates of 120 ml/m$^2$ for a developer or fixer in an amount of 100 sheets per day over period of 8 days. The samples were evaluated with respect to photographic performance at the start (fresh processing solutions) and completion of the running-processing of 800 sheets (running processing solutions).

| Developer composition (per liter of working solution) | |
|---|---|
| Pentasodium diethyltriaminepentaacete | 1 g/l |
| Sodium sulfite | 42.5 g/l |
| Potassium carbonate | 55 g/l |
| Hydroquinione | 20 g/l |
| 1-Phenyl-5-mercaptotetrazole | 0.03 g/l |
| 4-methyl-4-hydroxymethyl-1-phenyl-3-pyrazolidone (Dimezon S) | 0.85 g/l |
| Potassium bromide | 4 g/l |
| Benztriazole | 0.21 g/l |
| Boric acid | 8 g/l |
| Diethylene glycol | 40 g/l |
| 8-Mercapcoadenine | 0.078 g/l |
| Water to make | 1 liter |

The pH was made to 10.4. Fixer composition

| | |
|---|---|
| Ammonium thiosulfate (70% aq. solution) | 200 ml/l |
| Sodium sulfite | 22 g/l |
| Boric acid | 9.8 g/l |
| Sodium acetate trihydride | 34 g/l |
| Acetic acid (90% aq. solution) | 14.5 g/l |
| Tartaric acid | 3.0 g/l |
| Aluminum sulfate (27% aq. solution) | 25 ml/l |
| Water to make | 1 liter |
| The pH was made to 4.9. | |

The pH was made to 4.9.

Processing condition

| Step | Temperature | Time |
|---|---|---|
| Developing | 38° C. | 12 sec. |
| Fixing | 35° C. | 10 sec. |
| Washing | 40° C. | 10 sec. |
| Drying | 50° C. | 12 sec. |
| Total | | 44 sec. |

Evaluation of sensitivity and γ

Processed samples were sensitometrically measured with PDA-65 (Konica Digital Densitometer). A sensitivity is defined as reciprocal necessary for the exposure necesary for giving a density of 3.0. The sensitivity was shown as a relative value, based on the sensitivity of Sample 1 at a density of 3.0 being 100. As shown in Table 1, sensitivity difference refers to difference between a sensitivities obtained before and after the running processing. A minus value thereof, for example, refers to a decrease in sensitivity after the running-processing. The contrast (γ) was referred to as the slope of a straight line that connects two points corresponding to densities of 0.1 and 3.0. In the case of γ of less than 7, it is outside the range of practical use. A γ of not less than 7 but less than 10 is also insufficient for practical use. When the γ is 10 or more, high contrast images can be obtained and is acceptable for practical use.

Evaluation of black spot

Processed samples were visually observed with a 100× loupe. Evaluation was made, based on five grades of 5, 4, 3, 2 and 1, in order of increasing of black spots. Grade 1 and 2 were not be able to stand practical use.

Evaluation of lineaty

In the case when the sample was exposed through random-patterned halftone dots with SG-747RU by varying exposure so that 2% dots were reproduced to actually be 2%, the measurement was determined what percentage of dots were reproduced for dots of 95%. It is preferred to be as close to 95% as possible. (The sample was measured with X-Rite 361T and processed using running solutions.)

Prior to the above-described evaluations, each of emulsions A1, A2 and A3 was coated without the addition of a hydrazine compound, to prepare a photographic material sample. The sample was exposed, through a 633 nm interference filter, to high intensity light for $10^{-5}$ sec. When the sensitivity was expressed as a reciprocal of exposure that gave a density of 3.0, the relative sensitivity of A2 and A3 to that of A1 was proved to be −12.5% and +13%, respectively.

Next, emulsion A1 was coated with the addition of a hydrazine in an amount of $2\times10^{-3}$ mol/mol Ag to prepare a photographic material sample. The sensitivity of the sample was determined to evaluate the activity in development nucleation of the hydrazine compound. As a result, the relative sensitivity of hydrazine compounds H-6 and H-7, to that of H-8 (thus, the sensitivity difference as afore-described) was proved to be +25% and +13%, respectively.

Results of the evaluation are shown in Table 1. As can be seen from the Table, inventive samples are high in sensitivity and contrast and show little occurrence of black-spotting. It was further shown that, even when running-processed with an automatic processor at a low developer-replenishing rate and fixer-replenishing rate, there were fewer problems, such as variation in the sensitivity, deterioration in dot quality and dot for dot reproduction of fine dots.

TABLE 1

| Sample | Emulsion layer-1 | | Sensitivity | γ | | Black spot | | | |
|---|---|---|---|---|---|---|---|---|---|
| No. | Emulsion | Hydrazine | diff. | Fresh | Running | Fresh | Running | Linearity | Remark |
| 1 | A1 | H-8 | −35 | 15 | 12 | 5 | 3 | 100 | Comp |
| 2 | A2 | H-8 | −35 | 15 | 12 | 5 | 5 | 99.5 | Comp |
| 3 | A2 | H-6 | −10 | 21 | 20 | 5 | 5 | 98.5 | Inv. |
| 4 | A2 | H-7 | −12 | 21 | 19 | 5 | 5 | 98.6 | Inv. |
| 5 | A3 | H-6 | −11 | 22 | 20 | 5 | 5 | 97.5 | Inv. |
| 6 | A3 | H-7 | −13 | 21 | 18 | 5 | 5 | 97.6 | Inv. |

Photographic material Samples 7–9 were prepared in a manner similar to Sample 5 of Example 1, provided that the hydrazine compound of emulsion layer-1 was added in the form of a solid particle dispersion (Sample 7), the hydrazine compound of emulsion layer-2 was added in the form of a solid particle dispersion (Sample 8), or the hydrazine compounds of emulsion layer-1 and -2 were both added in the form of a solid particle dispersion (Sample 9). The solid particle dispersion was prepared by dispersing the hyrazine compound with the addition of naphthalene sulfonic acid, using ϕ 1 mm ZrO beads. Samples were evaluated in the same manner as in Example 1. The results thereof are shown in Table 2. As can be seen from the Table, samples in which at least one of the hydrazine compounds was added in the form of a solid particle dispersion were superior in running-processing stability and linearity. In particular, Sample 9, in which both of the hydrazine compounds were added in the form of a solid particle dispersion was proved to be excellent in processing stability and linearity.

TABLE 2

| Sample | Emulsion layer-1 | | Sensitivity | γ | | Black spot | | | |
|---|---|---|---|---|---|---|---|---|---|
| No. | Emulsion | Hydrazine | diff. | Fresh | Running | Fresh | Running | Linearity | Remark |
| 7 | A3 | H-6 | −7 | 21 | 18 | 5 | 5 | 96.4 | Inv. |
| 8 | A3 | H-6 | −8 | 21 | 18 | 5 | 5 | 96.2 | Inv. |
| 9 | A3 | H-6 | −1 | 21 | 18 | 5 | 5 | 95.5 | Inv. |

What is claimed is:

1. A silver halide black-and-white photographic light sensitive material comprising a support having thereon photographic component layers including a first silver halide emulsion layer containing a first hydrazine compound and a second silver halide emulsion layer containing a second hydrazine compound, the second silver halide emulsion layer being provided farther from the support than the first silver halide emulsion layer and having sensitivity higher than that of the first silver halide emulsion layer, wherein said first and second silver halide emulsion layers each have a coating weight of silver of not less than 0.5 g/$m^2$ and are sensitized substantially to the same spectral region, each of said first and second hydrazine compounds being different from the other and said first hydrazine compound having an activity of development nucleation higher than that of said second hydrazine compound.

2. The silver halide photographic material of claim 1, wherein said hydrazine compounds each are selected from a group of hydrazine compounds that are represented by the following formula (H),

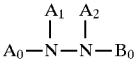

wherein $A_0$ represents an aliphatic group, aromatic group or heterocyclic group; $B_0$ represents a blocking group; $A_1$ and $A_2$ independently represent a hydrogen atom, acyl group, sulfonyl group, oxalyl group, provided that at least one of $A_1$ and $A_2$ is a hydrogen atom.

3. A method for preparing a silver halide black-and-white photographic light sensitive material as claimed in claim 1, wherein each of said first and second hydrazine compounds is incorporated in a photographic component layer by a process comprising:

(a) providing a support for said photographic light sensitive material;

(b) coating said support with photographic component layers including a first silver halide emulsion layer containing a first hydrazine compound and a second silver halide emulsion layer containing a second hydrazine compound, the second silver halide emulsion layer being farther from the support than the first silver halide emulsion layer and having a sensitivity higher than that of the first silver halide emulsion layer, wherein said first and second silver halide emulsion layers each have a coating weight of silver of not less than 0.5 $g/m^2$ and are sensitized substantially to the samespectral region, said first hydrazine compound being different from said second hydrazine compound, said first hydrazine compound being contained in said first silver halide emulsion layer or an adjacent layer to said first silver halide emulsion layer, and said second hydrazine compound being contained in said second silver halide emulsion layer or an adjacent layer to said second silver halide emulsion layer, said first hydrazine compound having an activity of development nucleation higher than that of said second hydrazine compound;

(c) dispersing solid particles of one of said first hydrazine compound and said second hydrazine compound in an aqueous medium to form a solid particle dispersion;

(d) adding the dispersion into a coating solution; and (e) using said coating solution containing said dispersion as one of said photographic component layers on said support.

* * * * *